US007913898B2

(12) United States Patent
Frankenberg et al.

(10) Patent No.: US 7,913,898 B2
(45) Date of Patent: Mar. 29, 2011

(54) COLLECTING CONTAINER, IN PARTICULAR FOR COLLECTING PACKAGES

(75) Inventors: Steffen Frankenberg, Rheinbach (DE); Martin Räss, Unterschleißeim (DE); Ramin Benz, Bonn (DE); Sven Hein, Salzkotten (DE); Boris Paul, Bonn (DE)

(73) Assignee: Deutsche Post AG, Bonn (DE)

( * ) Notice: Subject to any disclaimer, the term of this patent is extended or adjusted under 35 U.S.C. 154(b) by 110 days.

(21) Appl. No.: 12/438,294

(22) PCT Filed: Aug. 14, 2007

(86) PCT No.: PCT/EP2007/007171

§ 371 (c)(1), (2), (4) Date: Feb. 20, 2009

(87) PCT Pub. No.: WO2008/022730

PCT Pub. Date: Feb. 28, 2008

(65) Prior Publication Data

US 2010/0006636 A1 Jan. 14, 2010

(30) Foreign Application Priority Data

Aug. 21, 2006 (DE) ..... 10 2006 039 002

(51) Int. Cl.
*B65G 11/04* (2006.01)

(52) U.S. Cl. ..... 232/45; 232/30; 232/34; 232/43.3; 232/44; 312/297; 340/569; 49/197; 160/36

(58) Field of Classification Search ..... 232/45, 232/17, 47, 49, 44, 51–52, 30–32, 34–36, 232/43.3; 49/197, 199; 160/201, 36; 312/297; 220/252; 340/568.1, 569
See application file for complete search history.

(56) References Cited

U.S. PATENT DOCUMENTS 449,149 A * 3/1891 Whelan ..... 232/51
(Continued)

FOREIGN PATENT DOCUMENTS

DE 132498 7/1902
(Continued)

OTHER PUBLICATIONS

PCT International Preliminary Report on Patentability, International Application No. PCT/EP2007/007171, International Filing Date Aug. 14, 2007, pp. 11, and English Translation of International Preliminary Report on Patentability, pp. 5.

*Primary Examiner* — William L. Miller
(74) *Attorney, Agent, or Firm* — International IP Law Group, P.C.

(57) ABSTRACT

There is provided a collecting container. An exemplary collecting container comprises an insertion opening on the front of the collecting container that is adapted to receive objects. The exemplary collecting container additionally comprises a receiving device arranged to receive the objects and to convey them to a storage space in the collecting container, the storage space containing a filling-level measuring means that is connected to a blocking device preventing the receiving device from being opened when a defined filling level has been reached in the storage space, the receiving device comprising a roller shutter box whose receiving area is formed by at least two side walls and a bottom. The exemplary collecting container further comprises a roller shutter that is adapted to be moved in rails on the side walls, the blocking device being configured so that it can block the movement of the roller shutter.

16 Claims, 11 Drawing Sheets

U.S. PATENT DOCUMENTS

| | | | | | |
|---|---|---|---|---|---|
| 450,379 | A | * | 4/1891 | Sinclaire | 232/51 |
| 555,948 | A | * | 3/1896 | Harrison et al. | 232/49 |
| 561,589 | A | * | 6/1896 | Hower | 232/49 |
| 570,628 | A | * | 11/1896 | Gaschlin | 232/49 |
| 652,916 | A | * | 7/1900 | Kilne | 232/51 |
| 745,938 | A | * | 12/1903 | Wallace | 232/51 |
| 1,299,737 | A | * | 4/1919 | Koleta | 232/49 |
| 6,138,910 | A | | 10/2000 | Madruga | |
| 6,719,195 | B2 | * | 4/2004 | Farentinos | 232/45 |
| 6,918,534 | B2 | * | 7/2005 | Fitzgibbons et al. | 232/50 |
| 7,014,096 | B2 | * | 3/2006 | Hinds | 232/1 B |
| 7,320,427 | B2 | * | 1/2008 | Prestwich | 232/51 |
| 7,428,980 | B2 | * | 9/2008 | Irwin et al. | 232/45 |

FOREIGN PATENT DOCUMENTS

| | | |
|---|---|---|
| DE | 26919083 | 4/1998 |
| DE | 19950801 | 4/2001 |
| DE | 10351475 | 7/2004 |
| DE | 102004039618 | 3/2006 |
| DE | 202007003650 | 7/2007 |
| DE | 2002007003650 | 7/2007 |
| DE | 202008011484 | * 12/2008 |
| GB | 146111 | 6/1920 |
| WO | 03024287 | 3/2003 |

* cited by examiner (c)

(d)

COLLECTING CONTAINER, IN PARTICULAR FOR COLLECTING PACKAGES

CROSS REFERENCE TO RELATED APPLICATIONS

Pursuant to 35 U.S.C. §371, this application is the United States National Stage Application of International Patent Application No. PCT/EP2007/007171, filed on Aug. 14, 2007, the contents of which are incorporated by reference as if set forth in their entirety herein, which claims priority to German (DE) Patent Application No. 10 2006 039 002.4, filed Aug. 21, 2006, the contents of which are incorporated by reference as if set forth in their entirety herein.

BACKGROUND

An exemplary embodiment of the present invention relates to a collecting container.

Known collecting containers may be adapted to collect used clothing. The containers are normally characterized in that the receiving device is configured in such a way that, when used clothing is dropped into the container, the receiving device does not allow access to objects that have already been placed into the container. A collecting container of this type is disclosed, for example, in German utility model DE 296 19 083 U1.

In the realm of the collection of mail items, collecting containers are known that are designed to prevent access to mail already in the box when new mail is being dropped in. When it comes to mailboxes, the insertion slot is normally configured to be so narrow that it is not possible to access the mail that has already been dropped in.

Also in the realm of the collection of larger mail items such as packages and parcels, it is a known procedure to employ containers to collect such items. For instance, German patent application DE 103 51 475 A9 describes a mailbox for collecting packages that has an insertion opening and a storage space arranged below the insertion opening. There is a flap that can be pivoted about an axis that runs horizontally and, in the resting position, this flap closes the insertion opening. When a user wants to drop in a package, he pivots the flap forward toward himself and inserts the package. Here, the flap is configured in such a manner that, when it is open, it does not allow access to the packages that have already been dropped into the storage space. When the flap is closed, the entrance to the storage space is open and the package falls into the container.

With the collecting containers known from the state of the art, it can happen that a user still tries to insert packages into the container, even though this is no longer possible because the packages inside the container are stacked up all the way to the insertion flap. Moreover, there is a risk that objects might become damaged during the insertion procedure. This is a drawback especially in the case of collecting containers used for packages. Moreover, the packages can stack up directly below the insertion flap, as a result of which the space available inside the container is inadequately utilized. If the stack of packages reaches all the way up to the insertion flap, no more packages can be filled into the container, even though additional space is available elsewhere in the container.

SUMMARY OF THE INVENTION

An exemplary embodiment of the present invention may be adapted to overcome the drawbacks of the collecting containers known from the state of the art, and especially to provide a collecting container for receiving objects such as mail items with which, when the container is full, no further objects can be dropped in. Moreover, the interior of the container should be optimally utilized and, to the greatest extent possible, the objects should not be damaged when they are dropped in.

The collecting container according to an exemplary embodiment of the present invention may comprise an insertion opening for inserting objects on the front of the collecting container, and a removal opening. Inside the insertion opening, there is a receiving device for receiving the objects and for conveying the objects into a storage space in the collecting container. The receiving device can be moved between at least two operating states, in a first operating state, the receiving device allowing an object to be placed into it, while the entrance from the receiving device to the storage space is blocked. In a second operating state, an object cannot be placed into the receiving device, while the entrance from the receiving device to the storage space is open.

According to an exemplary embodiment of the present invention, the storage space contains a filling-level measuring device that is connected to a blocking device that prevents the receiving device from being opened when a defined filling level has been reached in the storage space.

As the filling-level measuring device, a deflector plate that protrudes into the storage space under the action of a preloaded spring is located, for example, on the rear wall of the collecting container. The deflector plate is configured in such a way that it can be deflected towards the rear wall upon contact with an object in the storage space. The deflector plate is connected to the blocking device that prevents the receiving device from being opened when a defined position of the deflector plate has been reached. Once the filling of the storage space with objects has caused the deflector plate to reach a certain position, the blocking device is activated and the receiving device can no longer be opened by a user.

Preferably, a distributor in the form of an angled section is mounted on the deflector plate, the two legs of the angled section facing downward and the angled section being arranged so as to be slanted downwards toward the front of the collecting container. Owing to this distributor, objects that have been dropped in are distributed to the left or to the right when they fall onto the distributor. Since the angled section is slanted downwards, the objects also fall downwards toward the front of the collecting container.

In an exemplary embodiment of the present invention, the interior of the storage space contains a catching device that essentially covers the horizontal cross section of the storage space. This catching device is connected to at least one suspension that can be moved vertically, so that said device can be moved vertically. The catching device may also be slanted downwards toward the front of the collecting container.

The catching device is attached to a suspension that, starting from an initial position at the top, can move downwards under the weight of an object. For instance, the suspension can be moved downwards against a defined spring force. The collecting container advantageously comprises a mechanism that uses suspension to move back to its initial position at the top once the objects have been removed from the catching device.

In a first exemplary embodiment of the present invention, the catching device is a net stretched between the side walls of the storage space. In a second exemplary embodiment, the catching device is configured as a rolling-type conveyor that extends between the side walls of the storage space.

The receiving device can be a tilting drawer whose receiving area is formed by at least two side walls, a front wall and a rear wall. The tilting drawer is rotatably mounted on a hinge in such a way that, in a first position, its rear wall covers the insertion opening while the receiving area of the drawer is accessible to a user. In a second position, the front wall of the tilting drawer covers the insertion opening of the collecting container while the entrance from the receiving area of the tilting drawer to the storage space is open.

The receiving device can also be a roller shutter box whose receiving area is formed by at least two side walls and a bottom. A roller shutter can be moved in rails on the side walls in such a way that, in a first position, the roller shutter covers the entrance from the receiving area of the roller shutter box to the storage space, while the receiving area of the roller shutter box is accessible to the user. In a second position, the roller shutter covers the insertion opening, while the entrance from the receiving area of the roller shutter box to the storage space is open.

In another embodiment of the invention, a lip is installed at the end of the roller shutter facing the storage space and serves as a means to measure the filling level. When contact is made with an object in the storage space, this lip can be deflected and it is connected to the blocking means that prevents the roller shutter from being opened when the lip has reached a defined deflection.

Advantageously, the blocking of the receiving device can be indicated on a display device of the collecting container. Furthermore, the blocking of the receiving device can be deactivated. For example, the blocking of the receiving device can be deactivated by opening a door of the removal opening. In another exemplary embodiment of the present invention, the blocking of the receiving device can be deactivated by entering a command on an input device.

A collecting container for packages according to an exemplary embodiment of the present invention may provide a drop-off possibility for packages, parcels and returns as an alternative to using a branch office. The package box allows items to be dropped off around the clock, irrespective of the locations and hours of operation of the branch offices.

An exemplary embodiment of the present invention may comprise a filling level measuring device that can prevent the collecting container from being opened when no more objects can be inserted due to a lack of space. This has the advantage that, already when the user arrives at the collecting container, he can see that it is full and that no additional objects can be dropped in. The filling level may be shown to the user on a display or in the form of a lit indicator. This is augmented by a mechanism that automatically blocks the container from being opened as soon as the filling-level measuring means has detected a defined filling level in the container.

The filling-level measuring device may comprise a catching device that essentially covers the cross section of the storage space of the collecting container, so as to catch the falling objects. Since the catching device can be moved vertically, when the container is empty, the catching device can be moved into an initial position at the top, where it catches the objects as directly as possible below the insertion device.

Thus, in this upper position, the catching device is preferably positioned at a height in which the dropped-in objects can be caught as soon as possible. Since the catching device is lowered because of the weight of the objects collecting on it, additional objects can then be inserted. These, however, do not fall all the way to the bottom of the container, but rather, are likewise caught by the catching device at the highest possible level.

The catching device thus constitutes a gravity brake and prevents packages from falling from a considerable height and being damaged. The catching device also reduces the impact of heavy packages onto more fragile packages located further down.

The downward slant of the catching device towards the front of the collecting container also prevents the objects from accumulating at the rear of the collecting container and stacking up to such an extent that no more objects can be dropped in even though the front area of the storage space is not filled up yet. Rather, the dropped-in objects always slide towards the front, thus freeing up space directly below the insertion opening for the next objects. This means that the entire storage space of the container can be optimally utilized.

Additional advantages, special features and practical refinements of the invention are described below with reference to the figures.

DETAILED DESCRIPTION OF SPECIFIC EMBODIMENTS

A collecting container according to an exemplary embodiment of the present invention may comprise an insertion opening on the front of the collecting container so that objects can be dropped in. The collecting container also has a removal opening for emptying the container. Inside the insertion opening, there is a receiving device that receives the objects and conveys them to a storage space in the collecting container. This receiving device can be moved between at least two operating states, in a first operating state, the receiving device allowing an object to be received in it, whereas the entrance from the receiving device to the storage space is blocked. In a second operating state of the receiving device, an object cannot be received in it, whereas the entrance from the receiving device to the storage space is open.

The collecting container according to an exemplary embodiment of the present invention will be described below with reference to several embodiments. Particularly in the form of a mailbox, the collecting container lends itself for collecting postal packages and/or parcels and it will be explained on the basis of this application purpose. The mail item is usually a pre-stamped mailpiece. The use of the container, however, is not restricted to the collection of mail items. Rather, any type of objects can be collected in the container. The collecting container is particularly well-suited for objects that should be protected against damage when they are dropped in.

Figure 1:
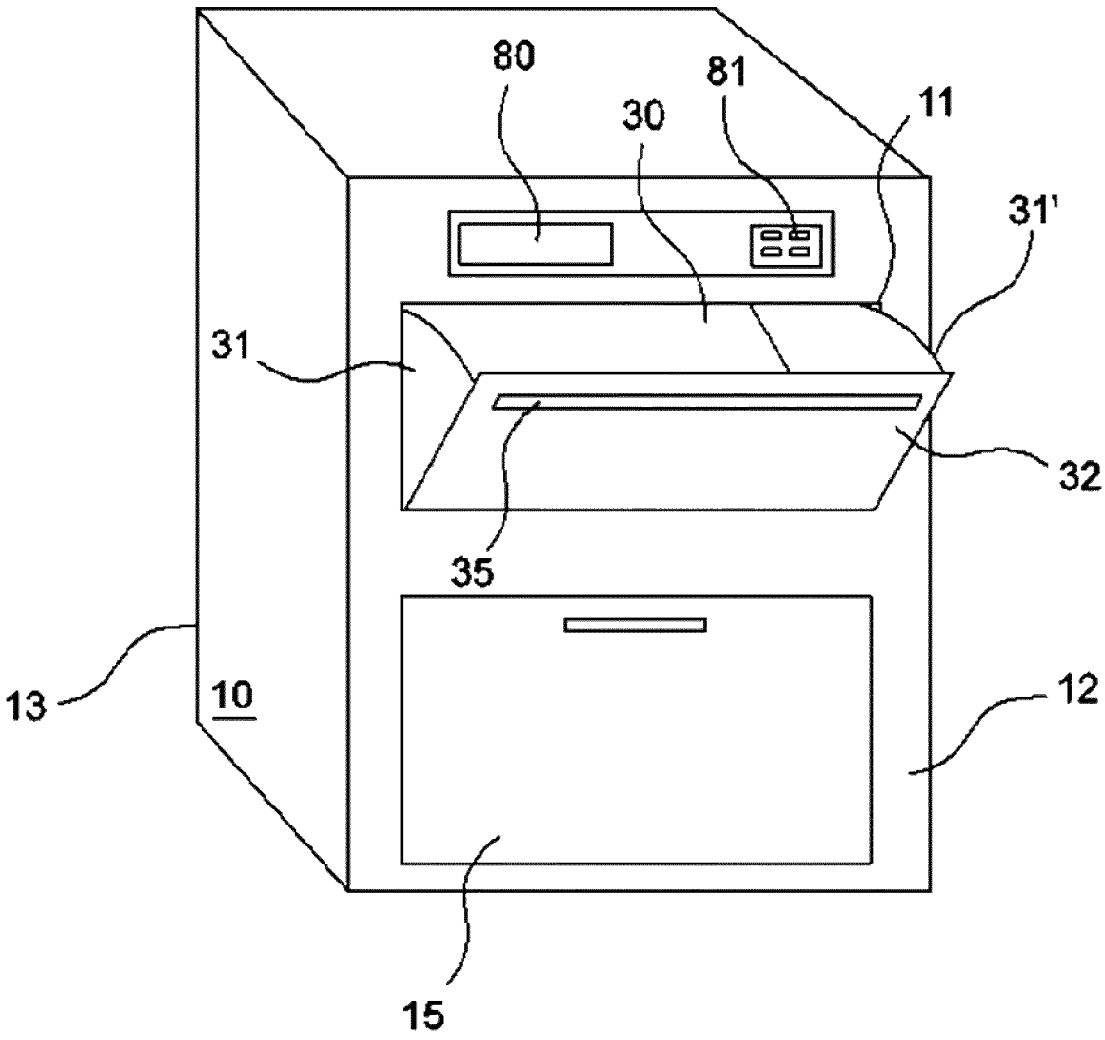
FIG. 1 is a perspective view of a collecting container according to an exemplary embodiment of the present invention, with a tilting drawer.

The basic structure of a container in accordance with an exemplary embodiment of the present invention will be presented with reference to FIG. 1. The exemplary collecting container 10 has a bottom plate, a cover plate, a front 12, a rear 13 and two side walls, thus forming a box-like housing. The contour of the collecting container can vary, although its interior always has a storage space 14 into which users can drop objects such as packages.

The housing of the collecting container 10 is preferably made of steel and is configured so as to be protected against forced entry. Moreover, the container is weather-resistant and it is installed in such a way that it cannot be unlawfully dismantled.

The packages are placed into the container via an insertion opening 11, and different types of receiving devices can be arranged inside the insertion opening. The receiving device is fundamentally configured in such a way that an access protection device prevents a user from reaching inside the container with or without tools so as to unlawfully remove or damage packages. For this purpose, the receiving device is constructed in such a way that the opening motion simultaneously triggers a mechanism that closes off access to the storage space of the container. Consequently, a user can gain access to the receiving device in order to place a package into it but he cannot gain access to packages that have already been dropped in. Closing the receiving device releases the blocking device and the package can fall into the storage space of the container.

As a receiving device, the collecting container in FIG. 1 has a tilting drawer 30. The tilting drawer consists of a front wall 32, a rear wall 33 and two side walls 31 and 31' which form the receiving area of the tilting drawer. The dimensions of the tilting drawer determine the maximum size of the packages that can be dropped into the container. The rear wall and the front wall can be perpendicular with respect to each other. However, it has proven to be practical to provide an angle greater than 90° between these two walls. In this case, the rear wall slants downwards when the tilting drawer is in its closed state, so that inserted objects slide downwards and do not remain lying in the receiving area of the tilting drawer.

Figure 2:
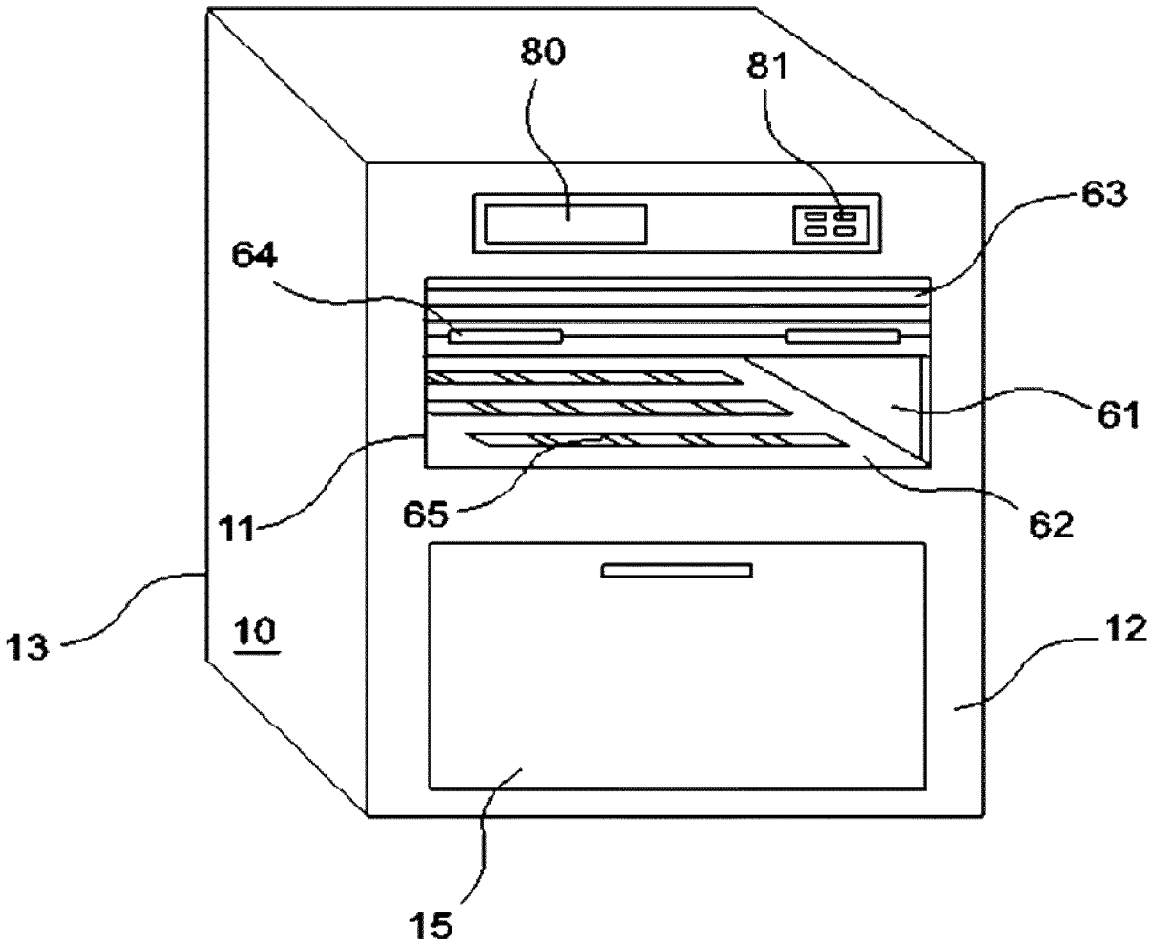
FIG. 2 is a perspective view of a collecting container according to an exemplary embodiment of the present invention, with a roller shutter box.

The tilting drawer can be pivoted about a horizontal axis using a hinge 34, as depicted in FIG. 2. The side walls 31 and 31' are designed with curved edges so that, when the drawer is tilted, the edges graze along the insertion opening without leaving too much space in-between.

In order to allow a dialog with the user of the collecting container 10, the container can also have an input device 81, for example, in the form of a keypad or a touch screen. Preferably, a display device 80 such as a monitor is also provided. As an alternative to or in addition to a monitor, illumination device can be provided such as lights or LEDs, for example, in order to indicate to the user the filling level of the container. The input and display devices are preferably connected to a data processing unit 82. If no electronic display device is provided, operating information such as rights and obligations can be displayed to the user on a permanent information surface when he goes to drop off a package.

The data processing unit 82 can be connected to a central data management unit that controls the operation of several collecting containers. For instance, the filling level of the collecting container can be transmitted to the central data management unit, in response to which an operator can be sent out to empty the container. Moreover, the data processing unit can detect and process the filling level in such a way that a message is displayed on a monitor to a user indicating that the collecting container is completely full and that no additional packages can be dropped in. As an alternative, if there is no monitor, the filling level can be indicated by means of lights or LEDs. For instance, a red LED can light up when the container is full and no additional packages can be dropped in, whereas a green LED lights up when additional packages can be dropped in.

An operator removes the dropped-in packages from the container through a removal opening 15 located on the front 12 and shown by way of an example in FIGS. 1 and 2. The removal opening is preferably provided with a door that can be opened, for instance, when the operator identifies himself at the data processing unit 82. In another embodiment of the invention, the door of the removal opening can be locked with a special key.

The tilting drawer 30 shown in FIG. 1 is configured such that access to the storage space 14 of the container is prevented when the tilting drawer is opened by a user. When the tilting drawer is swung forward by a user grasping the handle 35, the insertion opening 11 is covered by the rear 33 of the tilting drawer. The side walls 31 and 31' prevent anyone from reaching into the container from the sides. Reaching over the rear 33 is prevented in that the top edge of the rear 33 grazes tightly along the cover plate of the container and, thus, no space is left in-between for someone to reach in. Moreover, another curved plate whose curvature matches the roundness of the side walls 31 and 31' can be provided on the cover plate of the container so that not too much space is left between the rear and the curved plate.

In order to make it easier for the user to open and close the tilting drawer 30, mechanisms can be provided in the collecting container that support the tilting movement of the tilting drawer. Mechanical, pneumatic and/or hydraulic means are options for this purpose. For instance, a Bowden wire with weights can be provided.

FIG. 2 shows a second exemplary embodiment of the collecting container 10, with a receiving device in the form of a roller shutter box 60. The general features of the container can be configured analogously to those of the container according to FIG. 1.

The roller shutter box 60 has at least one bottom plate 62, two side walls 61 and 61' and a roller shutter 63 that can be moved in rails on the side walls. These components form a receiving area into which an object such as a package can be placed. The dimensions of the roller shutter box likewise determine the maximum size of the packages that can be placed there. At the front end of the roller shutter 63, which faces the outside of the container, there is preferably a handle 64 for manually moving the roller shutter in the rails.

When the roller shutter box is in its closed state, the roller shutter 63 extends at least over the insertion opening 11. Typically, it also extends along the top of the roller shutter box all the way to the rear of the receiving area thus formed. In another embodiment, the roller shutter can also run below the bottom plate 62 towards the back. In both cases, the rear of the roller shutter box is not closed off by the roller shutter, so that the entrance from the receiving area of the roller shutter box to the storage space 14 of the container is open when the roller shutter is closed.

The bottom plate 62 of the roller shutter box is preferably configured so as to be slanted slightly downwards toward the rear 13 of the collecting container 10, so that packages 20 placed onto the bottom plate slide towards the back. In one embodiment of the invention, the bottom plate 62 also has a rolling-type conveyor 65 on which the packages slide or roll towards the back through the open roller shutter box.

In order to insert a package 20 into the collecting container, the user moves the handle 64 upwards or downwards—depending on the embodiment in question—thus moving the roller shutter inside its rails. As a result, the roller shutter covers the rear area of the roller shutter box, thus preventing access to the storage space 14 of the container, while the roller shutter box is accessible from the front. The user places the package onto the rolling-type conveyor 65 and closes the roller shutter by once again moving the handle. The rear area of the roller shutter box is freed in this process and the package slides on the rolling-type conveyor 65 towards the back, where it then falls down into the storage space 14.

Figure 3:
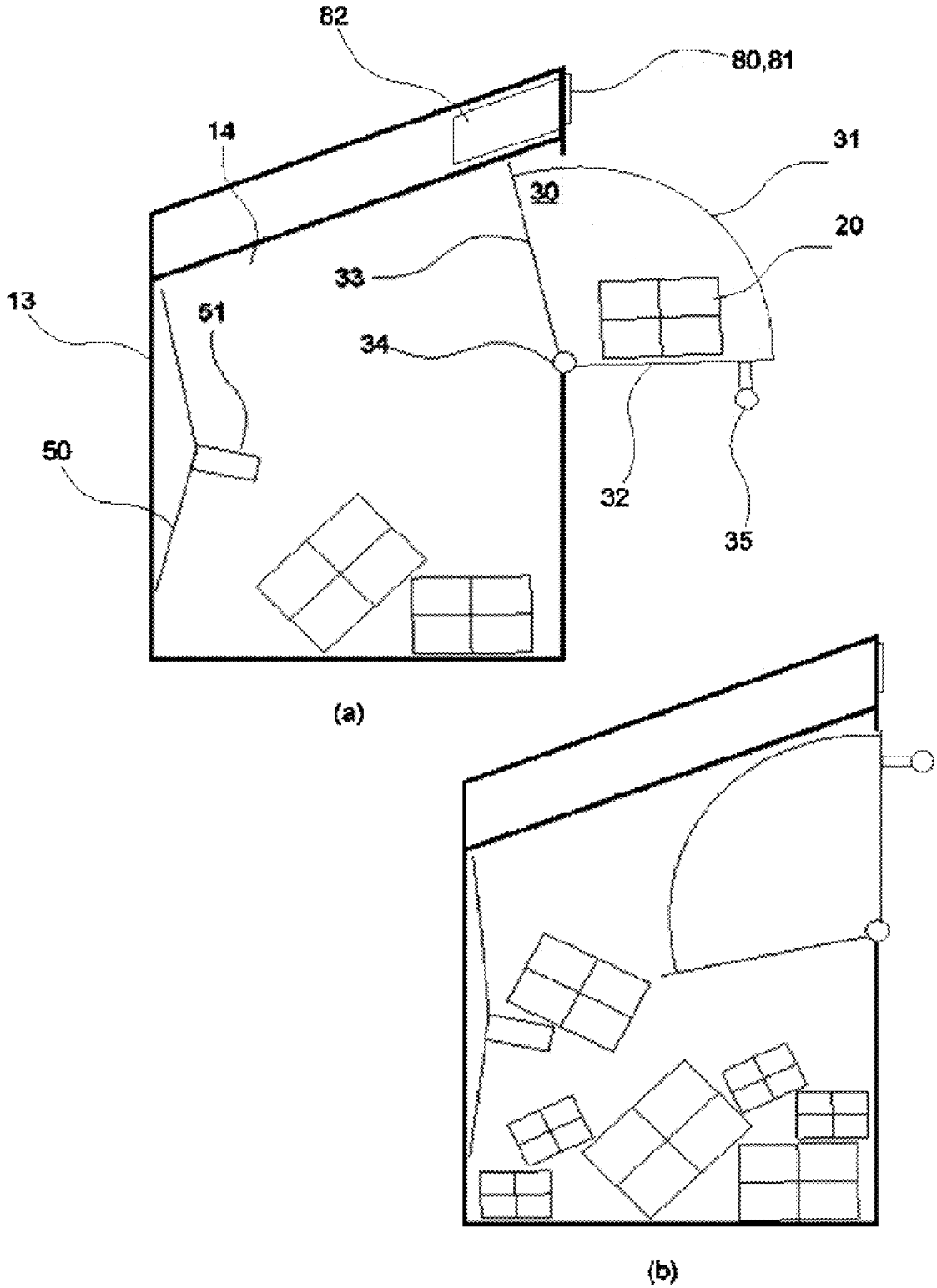
FIG. 3 is a cut-away side view of a collecting container according to an exemplary embodiment of the present invention, with a deflector plate.

FIG. 3 shows the insertion procedure for a collecting container having a tilting drawer 30. According to an exemplary embodiment of the present invention, a device for detecting the current filling level of the container is located inside the collecting container. The filling-level measuring device serves to prevent additional attempts by users to insert packages when the container is already so full that packages already dropped in might be damaged or that packages would remain in the receiving device since they cannot fall into the storage space because of the filling level.

The filling-level measuring device does not have to detect the actual filling level of the container, but rather, what is relevant for blocking the possibility to insert packages is the filling level below the receiving device. If the packages inside the container have, for example, stacked up unfavorably directly below the receiving device then, even though there might still be additional space available in the front area of the storage space, the receiving device should be blocked. The filling-level measuring device should fulfill these special requirements.

The filling-level measuring device depicted in the exemplary embodiments of the present invention shown in FIGS. 3 to 7 is a deflector plate 50 that is arranged inside the container on the rear 13 of the storage space 14. Under the action of a preloaded spring, the deflector plate 50 protrudes into the storage space 14 and is pressed against the rear wall 13 by the spring tension.

If the container is empty, the deflector plate is thus in its initial position in which it is completely pressed into the interior of the storage space by a spring. The more packages are dropped into the container, the closer the deflector plate is pressed against the rear wall 13. Once the deflector plate has reached a defined position there, a blocking device is triggered that prevents the receiving device from being opened again. This can be done, for example, by actuating a mechanical switch that then directly prevents the receiving device from being opened. When a tilting drawer is used, the drawer is prevented from being swung forward, and when a roller shutter box is used, the movement of the roller shutter is blocked.

The filling level and thus the blocking of the receiving device can also be shown to the user on the display device 80. For instance, the actuated switch is connected to the data processing unit 82, which generates a corresponding message on the monitor of the container. Thus, the user can be informed as to whether the collecting container is full and no additional filling is possible. In another embodiment of the invention, the receiving device is not blocked directly by a switch, but rather a blocking mechanism is actuated indirectly by the data processing unit.

In the exemplary embodiment of the present invention shown in FIG. 3, a distributor 51 in the form of an angled section is arranged on the deflector plate 50. The distributor 51, however, can also be attached directly to the rear wall 13 of the collecting container. The angled section is arranged in such a way that it is situated directly below the tilting drawer 30, so that packages that have been inserted fall onto the distributor. However, the distributor can also be combined with a receiving device in the form of a roller shutter box so that the packages fall out of the roller shutter box onto the angled section.

Figure 4:
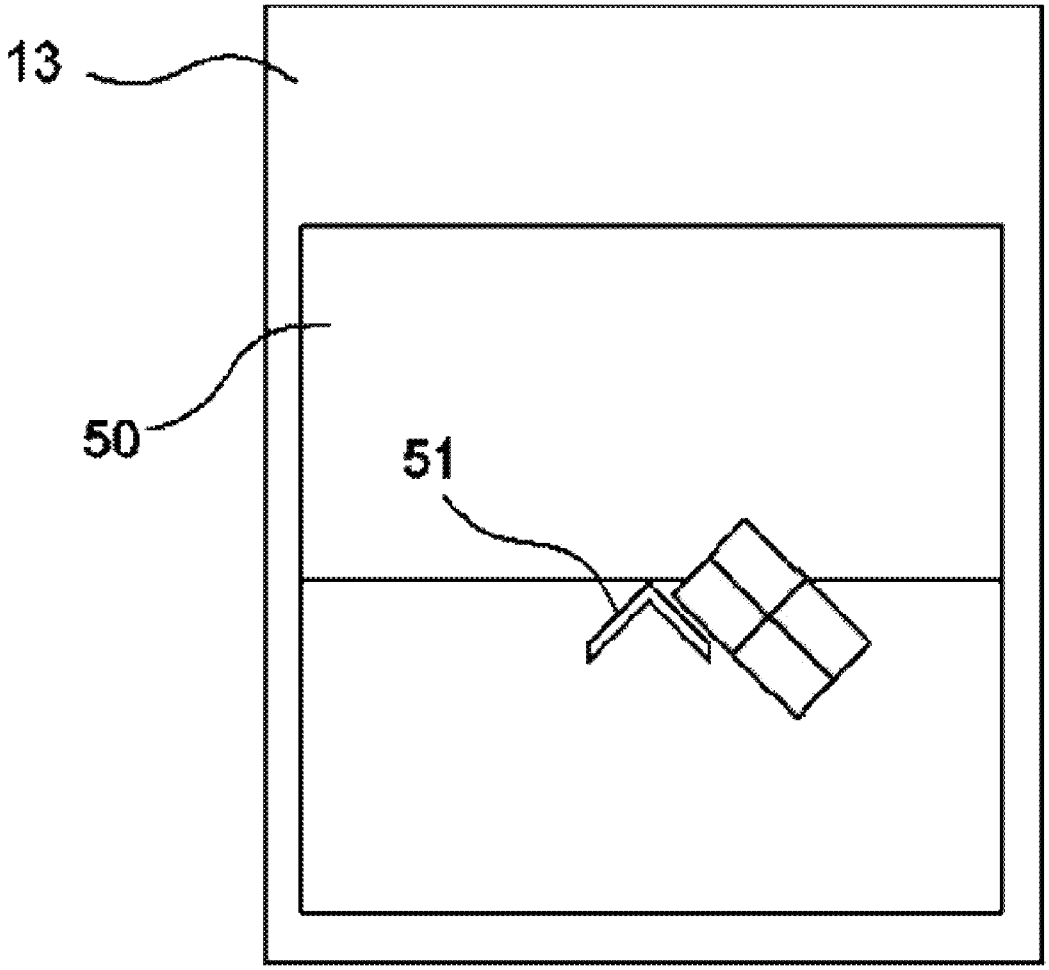
FIG. 4 is a schematic depiction of a deflector plate having a distributor in accordance with an exemplary embodiment of the present invention.

The two legs of the angled section 51 face downwards, so that a roof-shaped package separator is created that causes the packages to be individuated to either side. This arrangement is schematically shown in FIG. 4. Once a package has fallen onto the angled section, it tips over to one side, and in this manner, the package separator prevents that all of the packages come to lie in the center below the receiving device.

Preferably, a catching device to catch a package 20 as it falls is located in the storage space 14 of the collecting container 10. In the exemplary embodiment of the present invention shown in FIG. 4, the catching device is connected to at least one suspension 42 that can be moved vertically downwards. The catching device does not have to be moved downwards in its entirety, but rather, the invention also encompasses embodiments in which only parts of the catching device move downwards. The catching device is preferably held at a defined, starting height at the top by means of spring preloading of the suspension 42.

Figure 5:
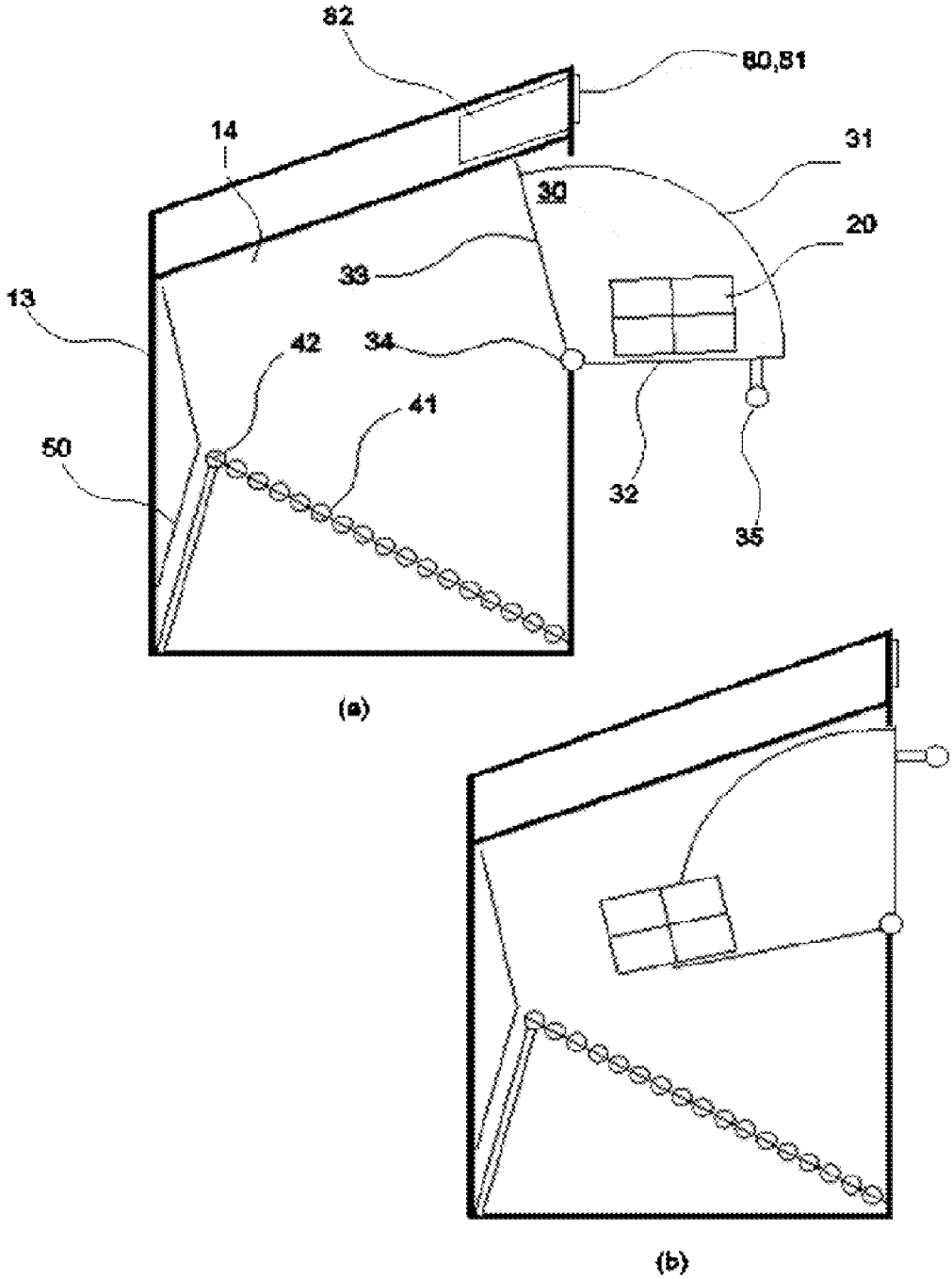
FIG. 5 is a cut-away side view that is useful in explaining the insertion procedure at a collecting container having a tilting drawer according to an exemplary embodiment of the present invention.

The catching device in the embodiment of the invention shown in FIG. 5 is a rolling-type conveyor 41 that covers the horizontal cross section of the storage space 14. As defined by the invention, covering the horizontal cross section does not mean that the entire cross section has to be completely covered. Rather, it is sufficient if the catching device extends over virtually the entire cross section even if, for instance, edge areas are not covered. Since packages are objects having relatively large dimensions, the receiving device only has to extend over the cross section of the storage space to such an extent that all of the falling packages can be caught.

The rolling-type conveyor 41 is preferably configured in such a way that, from a position at the top, it slants downwards toward the front of the container. This ensures that packages that fall out of a tilting drawer or a roller shutter box onto the rolling-type conveyor then slide or roll forward on the rolling-type conveyor. Each additional package slides on the rolling-type conveyor towards the front of the container so that the packages do not stack up directly below the receiving device. Therefore, the space in the front area of the container is utilized until it is full and packages can now only accumulate directly below the receiving device.

Figure 6:
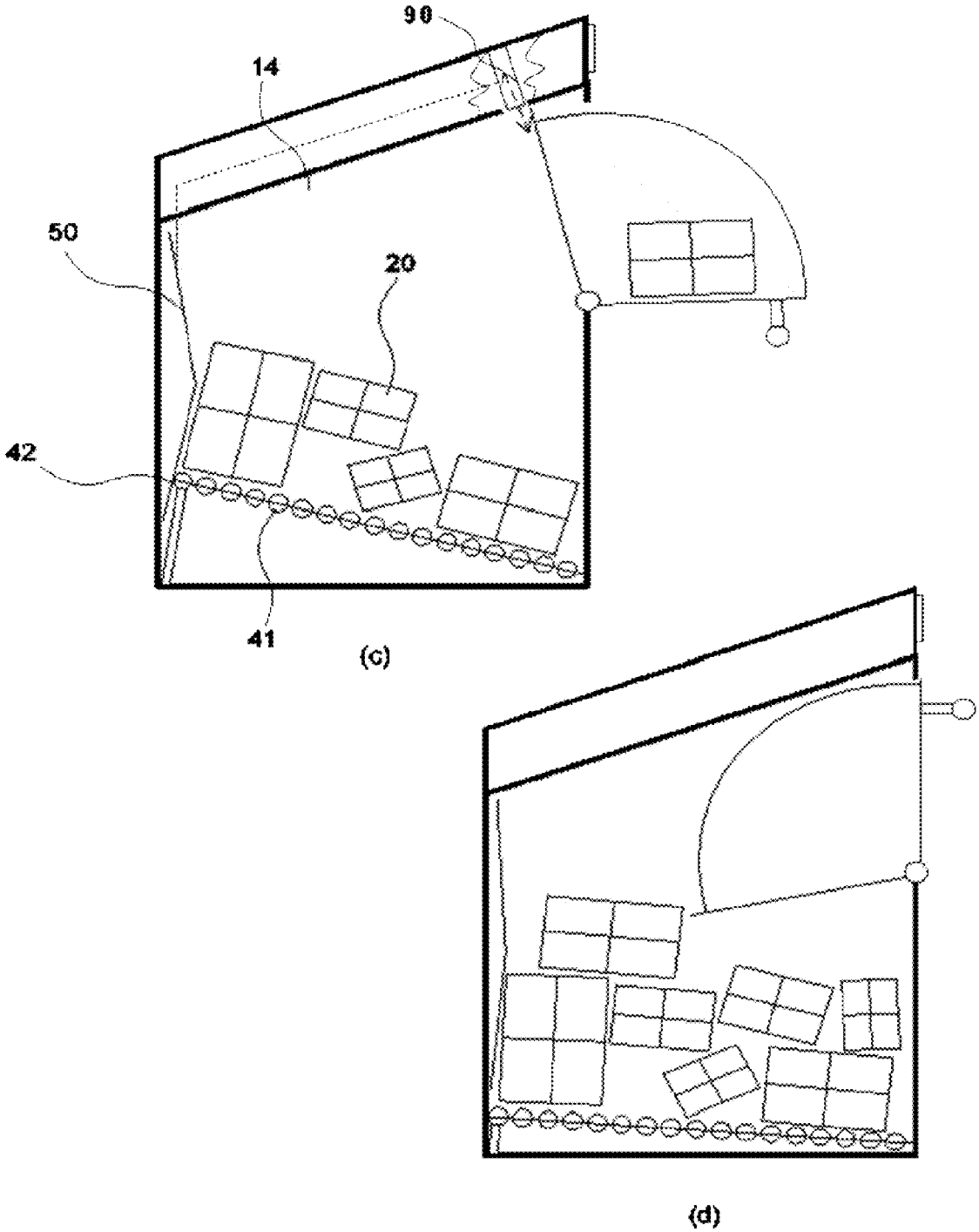
FIG. 6 is a cut-away side view that is useful in explaining the lowering of a rolling-type conveyor in a collecting container having a tilting drawer in accordance with an exemplary embodiment of the present invention.

The rolling-type conveyor 41 is also configured in such a manner that, in an initial position at the top, it is situated very close to the receiving device, so that an inserted package has the shortest possible falling distance. In the exemplary embodiment of the present invention shown in FIG. 5, the rolling-type conveyor is rotatably mounted on the front of the container and mounted in the rear using at least one suspension 42 so that it can be lowered. For example, the rolling-type conveyor moves downward against a preloaded spring as more and more packages are disposed on it. This lowering procedure is schematically shown in FIGS. 5 and 6 by steps a) to d). The rolling-type conveyor can also be connected to another suspension in the front area of the container, so that the slanted rolling-type conveyor moves downward in its entirety. In FIG. 6(*c*) in a part sectional view the blocking device 90 is shown in a non-blocking position. The blocking device 90 is connected to the deflector plate 50.

Figure 7:
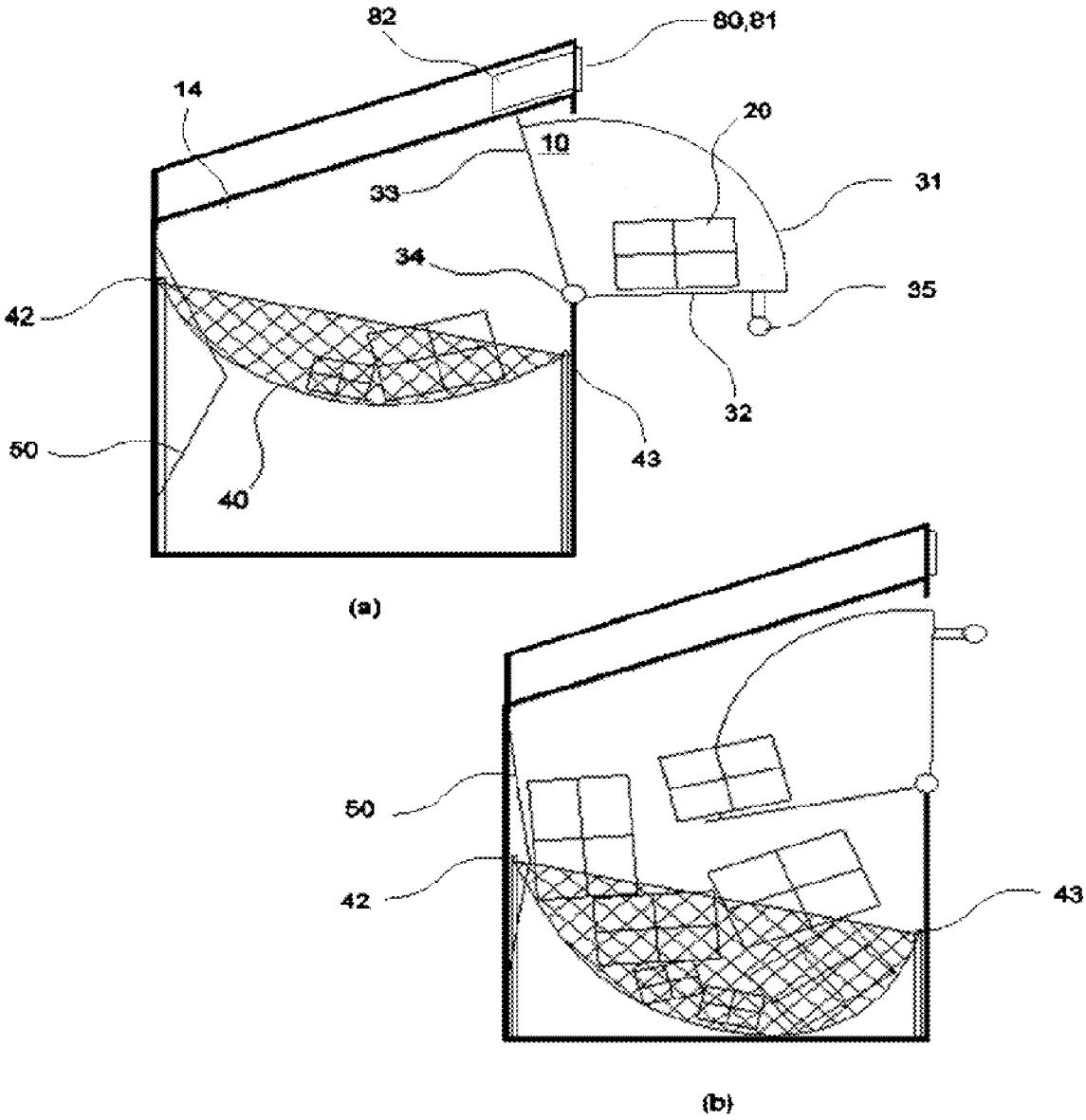
FIG. 7 is a cut-away side view that is useful in explaining the lowering of a net in a collecting container having a tilting drawer in accordance with an exemplary embodiment of the present invention.

FIG. 7 shows an exemplary embodiment of the present invention in which a net 40 is employed as the catching device. Since the net 40 is elastic, inserted packages can be caught gently. The net is preferably configured so as to be convex toward the bottom and likewise connected to at least one suspension 42 that moves downward when a weight is placed onto the net. Preferably, the net is stretched in the storage space 14 on several suspensions 42, 43 located opposite from each other in such a way that the rolling-type conveyor is slanted downwards toward the front of the container. Thus, inserted packages slide into the net towards the front of the container.

In the initial position at the top, the net is situated as close as possible below the receiving device. The more packages fall out of the tilting drawer onto the net 40, the further the net on the suspensions moves downward and can receive additional packages. This lowering procedure is schematically shown in FIG. 7 by steps a) and b). In this exemplary embodiment, a deflector plate 50 can likewise be used as the filling-level measuring device. Once the deflector plate has reached a defined position near the rear wall 13, the container is considered as being filled to the maximum, and the opening of the receiving device is blocked.

Figure 8:
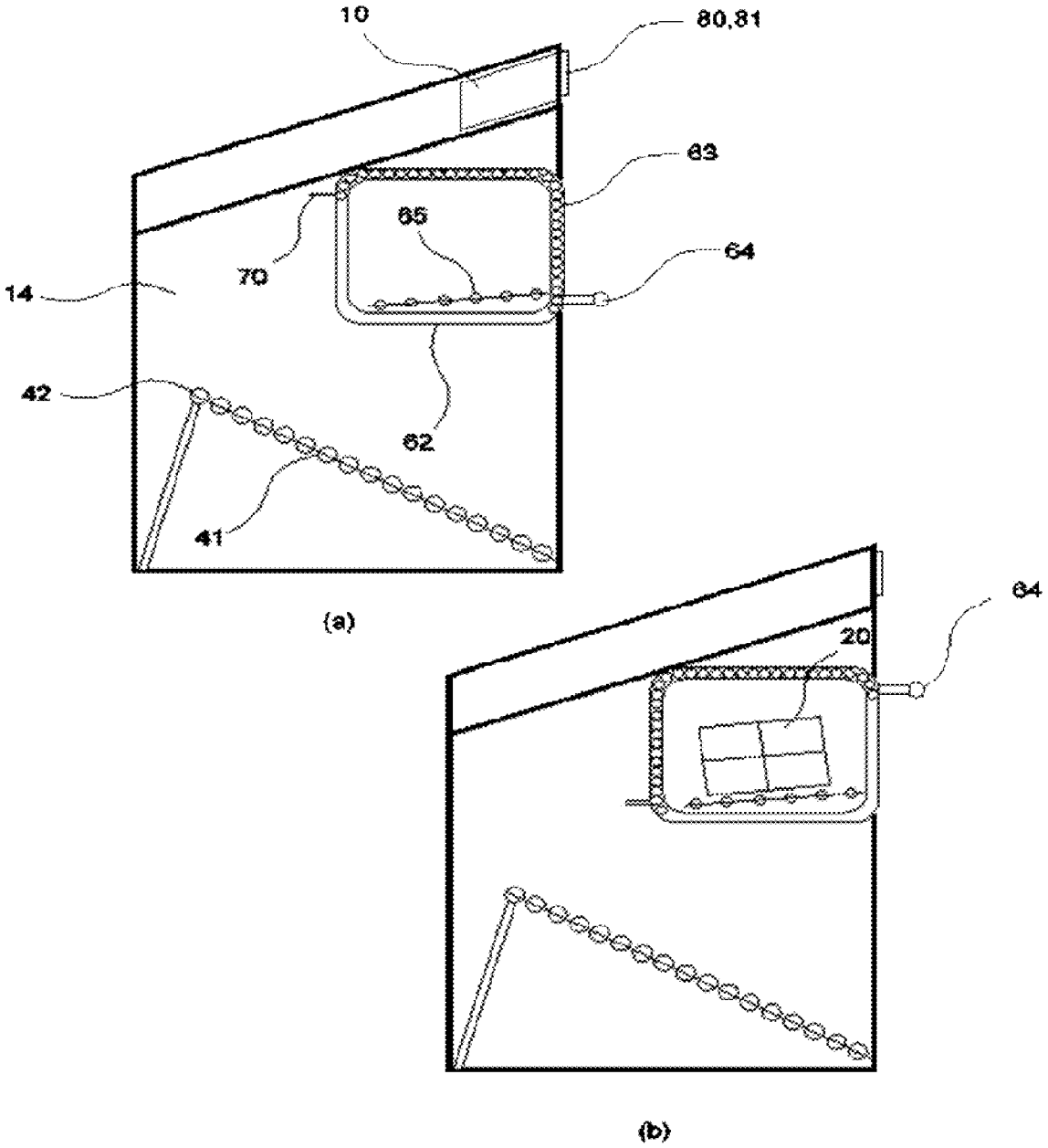
FIG. 8 is a cut-away side view that is useful in explaining the insertion procedure at a collecting container having a roller shutter box in accordance with an exemplary embodiment of the present invention.
Figure 9:
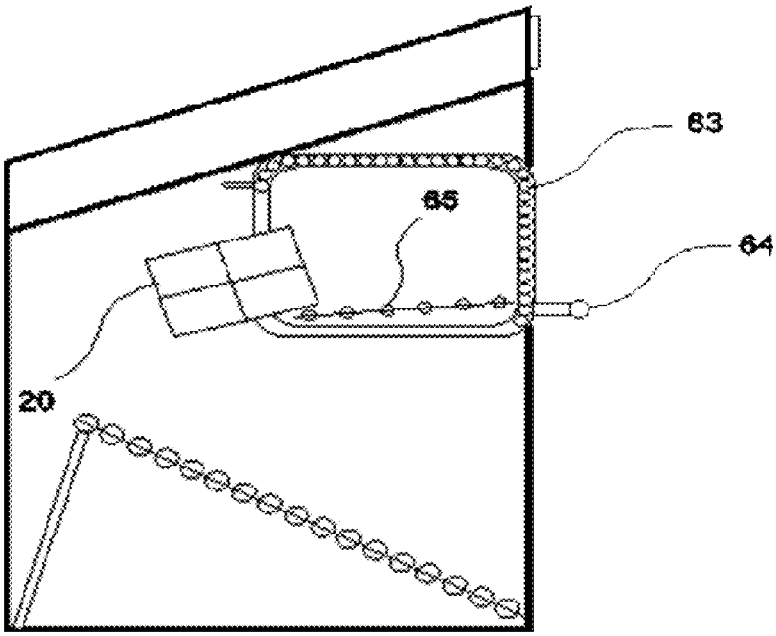
FIG. 9 is a cut-away side view that is useful in explaining the lowering of a rolling-type conveyor in a collecting container having a roller shutter box in accordance with an exemplary embodiment of the present invention.
Figure 9:
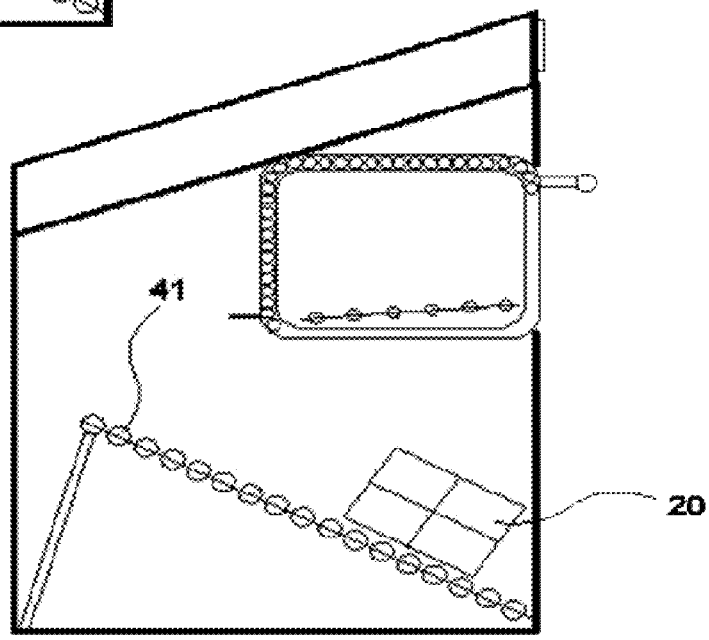
Figure 10:
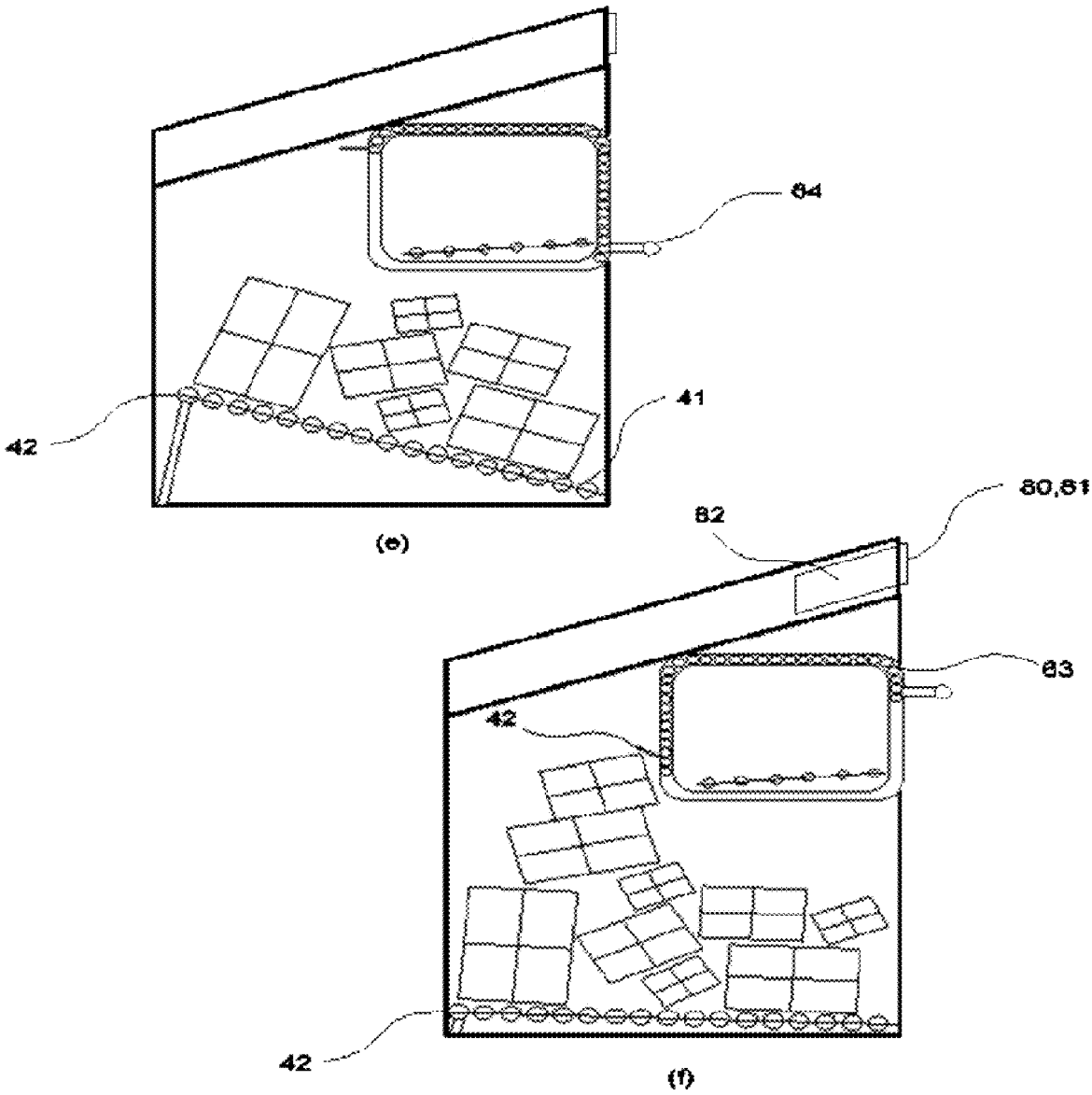
FIG. 10 is a cut-away side view that is useful in explaining the blocking of a roller shutter when a defined filling level has been reached in accordance with an exemplary embodiment of the present invention.

In FIGS. 8 to 10, steps a) to f) depict the insertion procedure in an exemplary embodiment of the present invention in which a roller shutter box 60 is used as the receiving device and a rolling-type conveyor 41 is used as the catching device. For purposes of measuring the filling level of the container, a lip 70 is provided at the rear end of the roller shutter 63, for example. When the container is empty, the lip is positioned, for example, perpendicular to the roller shutter, although it is mounted on the roller shutter so as to pivot upwards. The lip can be mounted resiliently. When the roller shutter is opened, the lip is always moved downward together with the rear end of the roller shutter. If the container is filled with packages to such an extent that the lip 70 strikes an object, it flips upwards, thus triggering the blocking of the roller shutter. This state is shown in FIG. 8, whereby the contact of the lip with an object takes place when the roller shutter is opened.

When a roller shutter box is used in which the roller shutter extends below the bottom plate 62, a lip can likewise be used as the filling-level measuring device. In this exemplary embodiment, however, the downward movement of the lip and thus the contact of the lip with an object take place when the roller shutter is closed.

The lip can serve, for instance, as a direct switch to block the roller shutter. In another exemplary embodiment of the present invention, the movement of the lip activates another control means that triggers the blocking of the roller shutter. For example, the data processing unit 82 can receive a signal from the lip 70 as a result of which it triggers the blocking of the roller shutter.

Figure 11:
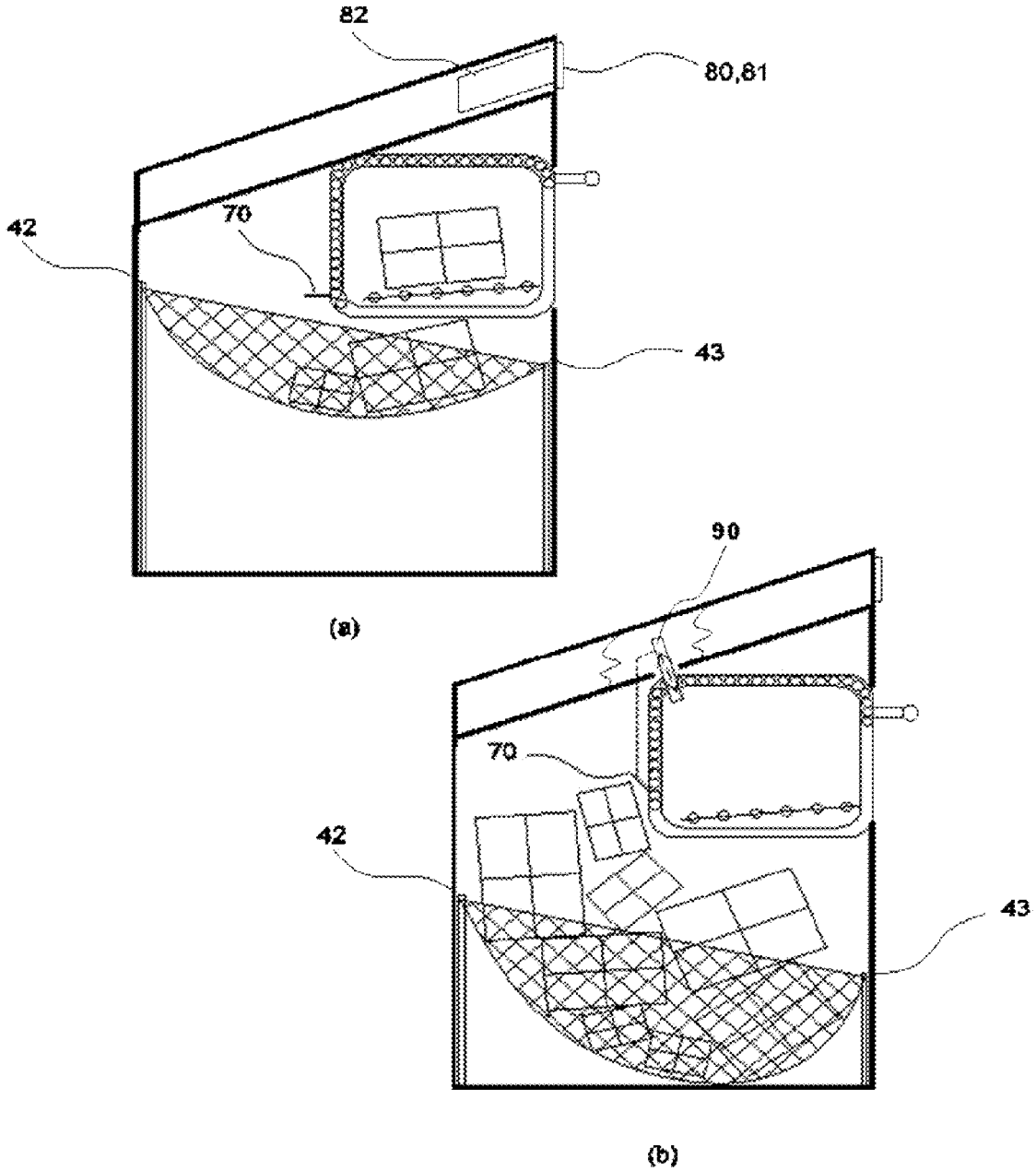
FIG. 11 is a cut-away side view that is useful in explaining the lowering of a net in a collecting container having a roller shutter box in accordance with an exemplary embodiment of the present invention.

FIG. 11 schematically shows in steps a) and b) the insertion procedure with a collecting container having a roller shutter box and a catching net 40 in accordance with an exemplary embodiment of the present invention. Here, a lip 70 is likewise used as the filling-level measuring device. However, a net can also be used with a deflector plate as the filling-level measuring device. Moreover, a distributor 51 that serves to individuate the packages to either side can be employed with all of the exemplary embodiments shown in FIGS. 5 to 11. In FIG. 11(*b*) in a part sectional view, the blocking device 90 is shown in a blocking position. In this position it blocks the roller shutter 63. The blocking device 90 is connected to the lip 70.

In an exemplary embodiment of the present invention, the receiving device in question is not located in the center of the front 12 of the container but rather offset horizontally thereto. For instance, a tilting drawer can be arranged on the left-hand side of the front. In this case, it can be practical for the catching device to be arranged on the suspensions in such a way that it slants not only downward towards the front but also downward to the right. If the receiving device is arranged, for instance, on the right side, the catching device is slanted forward to the left. This not only achieves a better distribution of the packages in the front and rear areas but also an improved distribution of the packages to either side. This slanted position of the catching device can be achieved particularly advantageously with a net.

If the maximum filling level of the collecting container has been reached and/or a certain time interval for an emptying procedure has been exceeded, the container is emptied by an operator and the emptying procedure is recorded. Subsequent to this, the filling level is reset. When the operator removes the packages through a removal door, the opening of the door can trigger, for example, a mechanism with which the filling level is automatically reset to "empty". The removal of the packages also causes the catching device to rise to its initial position at the top. For instance, the catching device can be moved into its initial position using spring force.

In order to allow the convenient removal of the packages from the catching device through the removal flap 15, the position of the flap can advantageously be affixed by the operator.

LIST OF REFERENCE NUMERALS

10 collecting container, package box
11 insertion opening
12 front of the collecting container
13 rear of the collecting container
14 storage space
15 removal opening, removal flap
20 object, mail item, package
30 tilting drawer
31, 31' side wall of the tilting drawer
32 front wall of the tilting drawer
33 rear wall of the tilting drawer
34 hinge, pivoting axis
35 handle of the tilting drawer
40 net
41 rolling-type conveyor
42, 43 suspension
50 filling-level measuring means, deflector plate
51 distributor, angled section, package separator
60 roller shutter box
61, 61' side wall of the roller shutter box
62 bottom of the roller shutter box
63 roller shutter

64 handle of the roller shutter box
65 rolling-type conveyor of the roller shutter box
70 filling-level measuring means, lip
80 display device, monitor, light, LED
81 input device, keypad, touch screen
82 data processing device
90 blocking device

The invention claimed is:

1. A collecting container, comprising:

an insertion opening on the front of the collecting container that is adapted to receive objects that are dropped in;

a removal opening;

a receiving device disposed in the insertion opening and arranged to receive the objects and to convey them to a storage space in the collecting container, the receiving device being movable between at least two operating states, a first operating state in which the receiving device allows an object to be received in it, while the entrance from the receiving device to the storage space is blocked, and a second operating state in which the receiving device does not allow an object to be received in it, while the entrance from the receiving device to the storage space is open, the storage space containing a filling-level measuring device that is connected to a blocking device preventing the receiving device from being opened when a defined filling level has been reached in the storage space corresponding to the second operating state, the receiving device comprising a roller shutter box whose receiving area is formed by at least two side walls and a bottom; and a roller shutter that is adapted to be moved in rails on the side walls in such a way that, in a first position corresponding to the first operating state of the receiving device, the roller shutter covers the entrance from the receiving area of the roller shutter box to the storage space, while the receiving area of the roller shutter box is accessible to the user and, in a second position corresponding to the second operating state of the receiving device, the roller shutter covers the insertion opening, while the entrance from the receiving area of the roller shutter box to the storage space is open, the blocking device being configured so that it can block the movement of the roller shutter.

2. The collecting container recited in claim 1, comprising a deflector plate inside the storage space on a rear wall of the collecting container, the deflector plate protruding into the storage space under the action of a preloaded spring, the deflector plate being configured so that it can be deflected towards the rear wall upon contact with an object in the storage space, the deflector plate operating as the filling-level measuring device being connected to the blocking device preventing the receiving device from being opened when a defined position of the deflector plate has been reached.

3. The collecting container recited in claim 1, comprising a distributor formed as an angled section on the deflector plate or a rear wall of the collecting container, the angled section having two legs facing downward, the angled section being slanted downward toward the front of the collecting container.

4. The collecting container recited in claim 1, comprising a catching device disposed in the storage space, the catching device essentially covering a horizontal cross section of the storage space, the catching device being connected to at least one suspension that can be moved vertically.

5. The collecting container recited in claim 4, wherein the catching device is slanted downwards toward the front of the collecting container.

6. The collecting container recited in claim 4, wherein the suspension is adapted to move downward from an initial position at the top, under weight of an object.

7. The collecting container recited in claim 4, wherein the suspension is adapted to be moved downward against a spring force.

8. The collecting container recited in claim 4, wherein the suspension is adapted to return to an initial position when objects have been removed from the catching device.

9. The collecting container recited in claim 4, wherein the catching device comprises a net stretched between the side walls of the storage space.

10. The collecting container recited in claim 4, wherein the catching device comprises a rolling-type conveyor that extends between the side walls of the storage space.

11. The collecting container recited in claim 1, comprising a lip at the end of the roller shutter, the lip operating as the fill-level measuring device, the lip facing the storage space, the lip being deflected when contact is made with an object in the storage space, the lip being connected to the blocking device to prevent the roller shutter from being opened when the lip has reached a defined deflection.

12. The collecting container recited in claim 1, wherein the blocking of the receiving device can be indicated on a display device of the collecting container.

13. The collecting container recited in claim 1, wherein the blocking of the receiving device can be deactivated.

14. The collecting container recited in claim 1, wherein the blocking of the receiving device can be deactivated by opening a door of the removal opening.

15. The collecting container recited in claim 1, wherein the blocking of the receiving device can be deactivated by entering a command on an input device.

16. A collecting container, comprising:

insertion opening means disposed on the front of the collecting container;

means for removing objects deposited in the collecting container;

means for receiving objects, the means for receiving objects being disposed in insertion opening means and arranged to receive the objects and to convey them to a storage space in the collecting container, the means for receiving objects being movable between at least two operating states, a first operating state in which the receiving device allows an object to be received in it, while the entrance from the means for receiving objects to the storage space is blocked, and a second operating state in which the means for receiving objects does not allow an object to be received in it, while the entrance from the means for receiving objects to the storage space is open, the storage space containing a filling-level measuring means that is connected to a blocking means preventing the means for receiving objects from being opened when a defined filling level has been reached in the storage space corresponding to the second operating state, the means for receiving objects comprising a roller shutter box whose receiving area is formed by at least two side walls and a bottom; and roller shutter means adapted to be moved in rails on the side walls in such a way that, in a first position corresponding to the first operating state of the means for receiving objects, the roller shutter means covers the entrance from the receiving area of the roller shutter box to the storage space, while the receiving area of the roller shutter box is accessible to the user and, in a second position corresponding to the second operating state of the means for receiving objects, the roller shutter means covers the insertion opening, while the entrance from the receiving area of the roller shutter box to the storage space is open, the blocking means being configured so that it can block the movement of the roller shutter means.

* * * * *